US008683902B2

(12) United States Patent
Nakada

(10) Patent No.: US 8,683,902 B2
(45) Date of Patent: Apr. 1, 2014

(54) SHEET POST-PROCESSING APPARATUS, IMAGE FORMING APPARATUS, AND IMAGE FORMING SYSTEM

(75) Inventor: Kyosuke Nakada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 274 days.

(21) Appl. No.: 13/325,477

(22) Filed: Dec. 14, 2011

(65) Prior Publication Data

US 2012/0152075 A1 Jun. 21, 2012

(30) Foreign Application Priority Data

Dec. 15, 2010 (JP) ..... 2010-278927

(51) Int. Cl.
*B26D 5/20* (2006.01)

(52) U.S. Cl.
USPC ..... 83/268; 83/276

(58) Field of Classification Search
USPC ..... 83/207, 268, 276; 412/1, 22
See application file for complete search history.

(56) References Cited

U.S. PATENT DOCUMENTS

| | | | | |
|---|---|---|---|---|
| 3,250,162 | A * | 5/1966 | Bunting | 83/23 |
| 3,732,766 | A * | 5/1973 | McCain et al. | 83/104 |
| 3,830,121 | A * | 8/1974 | Makeev et al. | 83/81 |
| 3,906,825 | A * | 9/1975 | Schenck et al. | 83/155.1 |
| 4,505,173 | A * | 3/1985 | Hartlage | 83/112 |
| 5,214,992 | A * | 6/1993 | Mohr | 83/268 |
| 7,976,450 | B2 * | 7/2011 | Endo | 493/407 |
| 2004/0126204 | A1 * | 7/2004 | Albrecht et al. | 412/22 |
| 2005/0191154 | A1 * | 9/2005 | Fujimoto et al. | 412/1 |
| 2005/0244252 | A1 * | 11/2005 | Hoarau | 412/1 |
| 2006/0032350 | A1 * | 2/2006 | Cote et al. | 83/13 |
| 2007/0116542 | A1 * | 5/2007 | Trovinger | 412/1 |
| 2011/0103863 | A1 | 5/2011 | Asami et al. | |
| 2011/0103919 | A1 | 5/2011 | Furuhashi et al. | |
| 2011/0103921 | A1 | 5/2011 | Suzuki et al. | |
| 2011/0229287 | A1 | 9/2011 | Suzuki | |
| 2011/0298202 | A1 * | 12/2011 | Hocking | 281/15.1 |
| 2012/0087765 | A1 * | 4/2012 | Suzuki | 412/1 |

FOREIGN PATENT DOCUMENTS

| | | | |
|---|---|---|---|
| JP | 2009161349 | A | 7/2009 |
| JP | 2010195582 | A | 9/2010 |

* cited by examiner

*Primary Examiner* — Sean Michalski
(74) *Attorney, Agent, or Firm* — Harness, Dickey & Pierce, P.L.C.

(57) ABSTRACT

A sheet post-processing apparatus that performs a cutting process on a booklet formed by a bundle of center-folded sheets of paper includes: a conveying member that conveys the booklet; a leading edge stopper capable of reciprocating in a booklet conveying direction and used for setting a cutting position by abutting on a center-folded portion of the booklet; and a supporting member that supports the booklet when the cutting position of the booklet is to be set. When the booklet is being conveyed, the conveying member and the conveyed booklet are located in a contact position, and when the cutting position of the booklet is to be set, each of the conveying member and the conveyed booklet is located in one of separated positions, and the cutting position of the booklet is set by the leading edge stopper while the conveyed booklet is supported by the supporting member.

9 Claims, 6 Drawing Sheets

SHEET POST-PROCESSING APPARATUS, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2010-278927 filed in Japan on Dec. 15, 2010.

BACKGROUND OF THE INVENTION

1. Field of the Invention

The present invention relates to a sheet post-processing apparatus used for cutting off an edge of a booklet produced by performing center folding in a process to bind sheets of paper, and an image forming apparatus and an image forming system that include the sheet post-processing apparatus.

2. Description of the Related Art

In the related art, in the field of printing, a sheet post-processing apparatus that includes a cutting device is practically used in which the cutting device cuts off an edge of a booklet that has passed through a saddle stitching process and a center folding process and performs edge alignment. In addition, recently, a sheet post-processing apparatus that includes a cutting device has been produced. The sheet post-processing apparatus receives sheets of paper with images thereon formed by an image forming apparatus such as a copying machine or a printer, performs a saddle stitching process and a center folding process, performs binding to produce, for example, a weekly magazine-like form, and allows the cutting device to cut off the edge of the booklet and to perform edge alignment.

In the cutting device described above, a booklet that has been produced through a saddle stitching process and a center folding process is conveyed by a conveying unit such as a belt such that a folded portion of the booklet becomes a leading edge in a conveying direction. Then, the booklet is stopped by abutting on an abutting member, and pressed at a portion near the folded portion by a first pressing unit and a portion near the edge by a second pressing unit, respectively. In this state, the edge is cut off by the cutting device. As a method for setting a position of the booklet when cutting is to be performed in this kind of an apparatus, there is a known position setting method according to which the booklet is stopped when the folding portion of the booklet abuts on a leading edge stopper, the leading edge stopper is moved toward the folded portion of the booklet, and the position of the booklet is set while posture of the booklet is corrected.

However, in the position setting method in the cutting device of the related art, there has been a problem in that the frictional force occurring between the conveying member and the booklet when the booklet slides on the conveying member is strong to cause defects such as cover peeling or an opposite arrangement between a right page and a left page when the booklet is opened after the edge has been cut off, thereby impairing the finishing quality of a sheet bundle.

Japanese Patent Application Laid-open No. 2010-195582 discloses a center-folded booklet conveying apparatus having a simplified mechanical structure capable of setting a position of a saddle-stitched and center-folded booklet to a predetermined position by a simplified conveying operation. The center-folded booklet conveying apparatus includes a booklet conveying unit that conveys a booklet having a saddle-stitched and center-folded portion and made of a plurality of sheet members in a state where the booklet is stacked on a booklet stacking member and a booklet position setting unit having a booklet abutting member for abutting on the center-folded portion and capable of reciprocating in a booklet conveying direction. The booklet is stopped when the position of the center-folded portion of the booklet having been conveyed by the booklet conveying unit is set at a downstream side of a predetermined position in the booklet conveying direction, and thereafter, the abutting member is moved the downstream to an upstream side in the booklet conveying direction to abut on the center-folded portion and further to press center-folded portion backwards in the booklet conveying direction, thereby to set the position of the booklet to the predetermined position by sliding the booklet on the stacking member.

However, the problems caused by the strong frictional force between the conveying member and the booklet have not been unresolved yet. That is, defects such as cover peeling or an opposite arrangement between a right page and a left page when the booklet is opened after the edge has been cut off deteriorates the finishing quality of a bundle of sheets.

Therefore, there is a need to improve the quality of a booklet by retracting a conveying member with a large coefficient of friction when the position of the booklet in the cutting device is to be set, by reducing a frictional force associated with the conveyance of the booklet accomplished by letting the booklet slide on a different supporting member than the conveying member, and by achieving stability in conveying the booklet.

SUMMARY OF THE INVENTION

It is an object of the present invention to at least partially solve the problems in the conventional technology.

A sheet post-processing apparatus that performs a cutting process on a booklet formed by a bundle of center-folded sheets of paper includes: a conveying member that conveys the booklet; a leading edge stopper capable of reciprocating in a booklet conveying direction and used for setting a cutting position where the cutting process is to be performed by abutting on a center-folded portion of the booklet; and a supporting member that supports the booklet when the cutting position of the booklet is to be set. When the booklet is being conveyed, the conveying member and the conveyed booklet are located in a contact position where the conveying member and the conveyed books are in contact with each other, and when the cutting position of the booklet is to be set, each of the conveying member and the conveyed booklet is located in one of separated positions that are separated from each other, and the cutting position of the booklet is set by the leading edge stopper while the conveyed booklet is supported by the supporting member.

An image forming apparatus includes a sheet post-processing apparatus that includes: a sheet cutting device that performs a cutting process on a booklet formed by a bundle of center-folded sheets of paper and that includes: a conveying member that conveys the booklet; a leading edge stopper capable of reciprocating in a booklet conveying direction and used for setting a cutting position where the cutting process is to be performed by abutting on a center-folded portion of the booklet; and a supporting member that supports the booklet when the cutting position of the booklet is to be set. When the booklet is being conveyed, the conveying member and the conveyed booklet are located in a contact position where the conveying member and the conveyed books are in contact with each other, and when the cutting position of the booklet is to be set, each of the conveying member and the conveyed booklet is located in one of separated positions that are separated from each other, and the cutting position of the booklet is set by the leading edge stopper while the conveyed booklet is supported by the supporting member.

An image forming system includes a sheet post-processing apparatus that includes: a sheet cutting device that performs a cutting process on a booklet formed by a bundle of center-folded sheets of paper and that includes: a conveying member that conveys the booklet; a leading edge stopper capable of reciprocating in a booklet conveying direction and used for setting a cutting position where the cutting process is to be performed by abutting on a center-folded portion of the booklet; and a supporting member that supports the booklet when the cutting position of the booklet is to be set. When the booklet is being conveyed, the conveying member and the conveyed booklet are located in a contact position where the conveying member and the conveyed books are in contact with each other, and when the cutting position of the booklet is to be set, each of the conveying member and the conveyed booklet is located in one of separated positions that are separated from each other, and the cutting position of the booklet is set by the leading edge stopper while the conveyed booklet is supported by the supporting member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the present invention, a conveying member (belt) having a high frictional coefficient is separated from a booklet when a position of the booklet is set in a cutting device, and the booklet is made to be supported by and slide on a supporting member that has a low frictional coefficient, thereby to reduce a frictional force when the position of the booklet is to be set. Therefore, booklet conveyance is stably performed, and a quality of the booklet can be improved. That is, because the conveying member has functions of stopping and conveying the booklet with static friction, the conveying member has a high frictional coefficient. When the booklet is made to set a position by a sliding motion, the booklet is separated from the conveying member that has a high frictional coefficient, and the booklet is made to slide on the supporting member that has a low frictional coefficient, thereby the frictional force applied to the booklet is reduced and deformation of the booklet is decreased.

EMBODIMENT

First Embodiment

A first embodiment will be described in detail with reference to the drawings.

Figure 1:
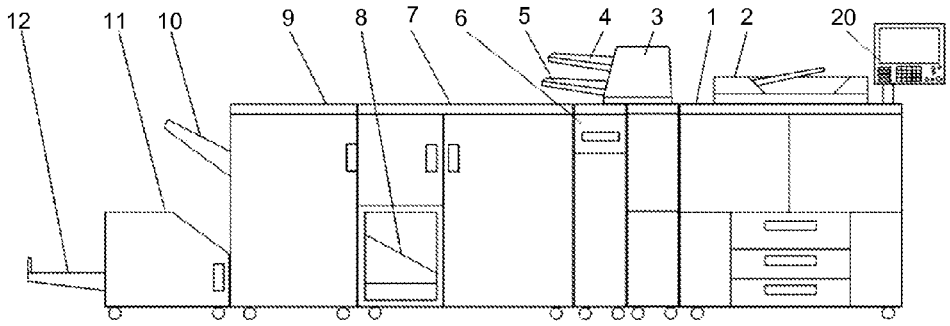
FIG. 1 is a schematic diagram illustrating a configuration of a sheet post-processing apparatus according to an embodiment of the present invention and a configuration of an image forming system that includes an image forming apparatus equipped with the sheet post-processing apparatus.

FIG. 1 is a schematic diagram illustrating a configuration of a sheet post-processing apparatus according to the embodiment and a configuration of an image forming system that includes an image forming apparatus equipped with the sheet post-processing apparatus. In FIG. 1, the image forming system according to the embodiment basically includes an image forming apparatus 1, an inserter device 3, a paper folding apparatus 6, a binding apparatus 7, a post-processing apparatus 9, and a cutting apparatus 11.

In the embodiment, the image forming apparatus 1 is configured as a digital Multi-Function Peripheral (MFP) and includes an automatic document feeder (ADF) 2 and an operation panel 20 attached with a liquid crystal display 20*b*. The image forming apparatus 1 is connected to an inserter device 3 at a downstream side in a sheet conveying direction.

The inserter device 3 has two sheet trays 4 and 5 and can insert a sheet on which an image has been formed or a sheet that cannot pass through the image forming apparatus 1 independently, before or after a sheet output from the image forming apparatus 1, or between arbitrary sheets. A sheet folding apparatus 6 that can perform various kinds of folding such as Z folding or tri-folding is connected at the downstream of the inserter device 3.

In addition, a binding apparatus 7 is connected at the downstream of the sheet folding apparatus 6. The binding apparatus 7 includes a binder such as a tape binder, a ring binder, or a glue binder. The booklet on which the binding has been performed is to be discharged on a binding tray 8.

In addition, the post-processing apparatus 9 is connected to a position in the downstream side of the sheet folding apparatus 6. As described later, the post-processing apparatus (finisher) 9 includes a punching unit and a stapling unit capable of performing punching and staple binding, respectively. In addition, the post-processing apparatus 9 in the image forming system is also configured to have a function capable of producing a saddle-stitched booklet. Various well-known techniques may be employed to implement these functions.

The sheet to which general discharging or edge binding by staple stitching is performed is discharged on a post-processing tray 10, and the cutting apparatus 11 is connected to a position on the downstream side thereof. The cutting apparatus 11 has a function of receiving the booklet that is saddle-stitched by the post-processing apparatus 9 and cutting off and aligning the edge of the booklet. After cutting, the booklet is discharged on a stacking tray 12 to be stacked thereon.

Figure 2:
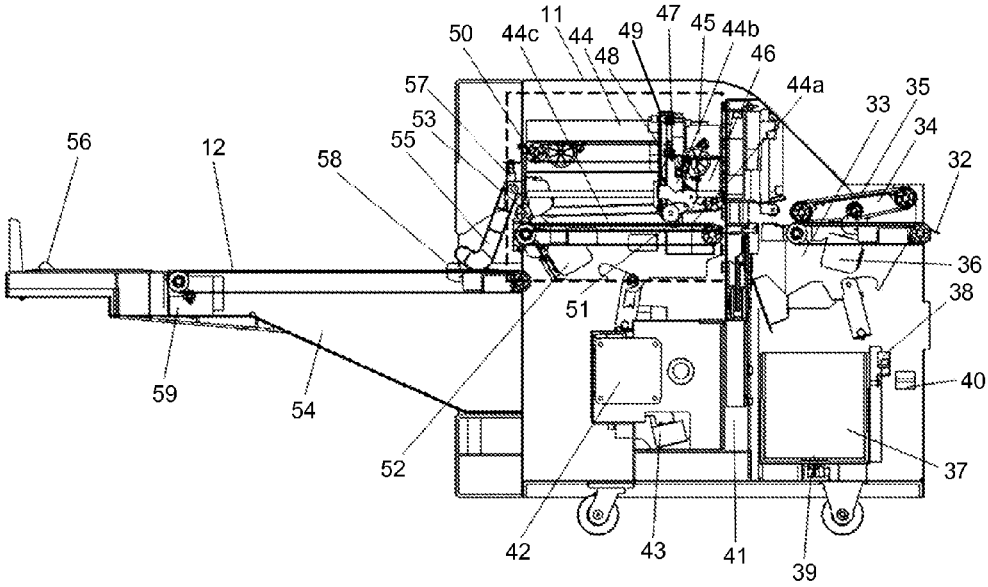
FIG. 2 is a schematic diagram illustrating a mechanical configuration of a cutting device illustrated in FIG. 1 and a saddle-stitching stacking tray attached to the cutting device.

FIG. 2 is a schematic diagram illustrating a mechanical configuration of the cutting apparatus 11 and the stacking tray 12 attached to the cutting apparatus 11 according to the embodiment. In the image forming apparatus 1 illustrated in FIG. 1, sheets fed from a main body of the image forming apparatus 1 or the inserter device 3 are saddle-stitched and bound as a bundle of sheets by the post-processing apparatus 9, so that a booklet 25 is formed. The booklet 25 is discharged from the post-processing apparatus 9 in the direction along which the back side (folded side) is set as a leading edge. The cutting apparatus 11 is provided to be adjacent to the post-processing apparatus 9 in the downstream side and receives the discharged saddle-stitched booklet 25.

The cutting apparatus 11 is configured to include a feeding unit 31, a position setting unit 44, a cutter unit 41, and a tray unit 54. The feeding unit 31 includes an inlet guide plate 32, feeding guides 33 and 34, a carrying-in sensor 35, and a feeding side conveying motor 36. The saddle-stitched booklet 25 is conveyed from the inlet guide plate 32 to the feeding unit 31 and conveyed by being interposed between the upper and lower feeding guides 33 and 34.

As for the feeding guides 33 and 34, the upper feeding guide 34 is a belt having a circular cross-section, the lower feeding guide 33 is a flat belt, and the booklet 25 is conveyed by being interposed therebetween. In order to accept booklets 25 with various amounts of thickness, the upper feeding guide 34 can oscillate about a fulcrum provided at the inlet side, so that a gap between the upper and lower feeding guides 33 and 34 can be widened according to the thickness of the booklets 25.

The position setting unit 44 includes a conveying member 44*a*, an abutting member 44*b*, and a supporting member 44*c*. In addition, with respect to the driving of the elements, a position-setting side inlet roller pressing motor 45, a position-setting side inlet roller pressing sensor 46, a position-setting home position (HP) sensor 47, an abutting member unit press motor 48, an abutting member HP sensor 49, an abutting member unit moving motor 50, an abutting member unit sheet sensor 51, a position-setting side carrying-out motor 52, and a discharging sensor 53 are provided therein.

The booklet 25 that has been conveyed from the feeding unit 31 is conveyed to the position setting unit 44. The conveyed booklet 25 is stopped at a position downstream from a cutting position, and the booklet 25 is separated from the conveying member 44*a* and supported by the supporting member 44*c*. Next, the abutting member 44*b* abuts on the center-folded portion of the booklet 25 to make the booklet 25 slide to reach the cutting position, thereby performing position setting. In addition, after the position setting, the booklet 25 is pressed and flattened by using a press mechanism that includes the abutting member unit press motor 48 and the like to prepare for cutting.

A cutter unit 41 is provided between the feeding unit 31 and the position setting unit 44. A cutter type is so-called a guillotine type, where an upper blade is a movable blade that has an acute, shearing angle, and the lower blade is a fixed blade having an obtuse angle of about 90 degrees at an edge. The booklet 25 of which the cutting position has been set by the position setting unit 44 is cut by the operation in which the upper blade of the cutter unit 41 is driven by a cutter motor 42 to move down. In order to prevent deviation of a bundle of the sheets at the time of cutting, a press mechanism is provided for pressing the sheets. Before the upper blade moves down, the press mechanism strongly presses the booklet 25 at a portion near the cutting portion, and thereafter, the booklet 25 is cut by a downward motion of the upper blade. In addition, reference numeral 43 denotes a home position sensor for detecting a home position of the cutter.

Cutting waste generated from the cutting operation by the cutter unit 41 falls by gravity to be inserted into a trash receptacle 37 provided below the cutting device. The trash receptacle 37 is provided with a sensor 38 for detecting whether or not the trash receptacle is full of the cutting waste and a sensor 39 for detecting whether a trash can is set.

The tray unit 54 includes a discharging lever 55, a first full-capacity sensor 56, a second full-capacity sensor 57, a remaining-sheet sensor 58, and a tray conveying motor 59. The pressing pressure is released from the booklet 25 which the edge has been cut, the conveying member 44*a* is returned from a booklet separating position to a booklet conveying position, thereby starting the conveying process. The booklet is conveyed to the discharging portion and discharged on the stacking tray 12 by a discharge roller (not shown). At this time, the abutting member 44*b* is brought into contact with the trailing edge of the booklet for assisting to discharge the booklet, so that the booklet is prevented from being not completely discharged with the trailing edge remaining in the apparatus. A pair of flat belts 24, and a driving mechanism for driving the flat belts 24 are provided on the stacking tray 12 so that the conveyance of the booklet 25 and the adjustment of the stacked posture can be performed. Therefore, when the booklet 25 is discharged, the flat belts 24 are moved, so that the booklet 25 is conveyed little by little.

FIGS. 3A to 3D are diagrams illustrating an operation method of separating a booklet from a conveying member according to the embodiment. The position setting unit illustrated in FIGS. 3A to 3D includes a conveying member 44*a*, an abutting member 44*b*, and a supporting member 44*c*. In addition, with respect to the driving of the elements, a conveying member lifting motor 60, a conveying member lifting mechanism 61, an abutting member lifting motor 62, an abutting member lifting mechanism 63, an abutting member conveying direction moving motor 64, and an abutting member conveying direction moving mechanism 65 are provided therein.

Figure 3A:
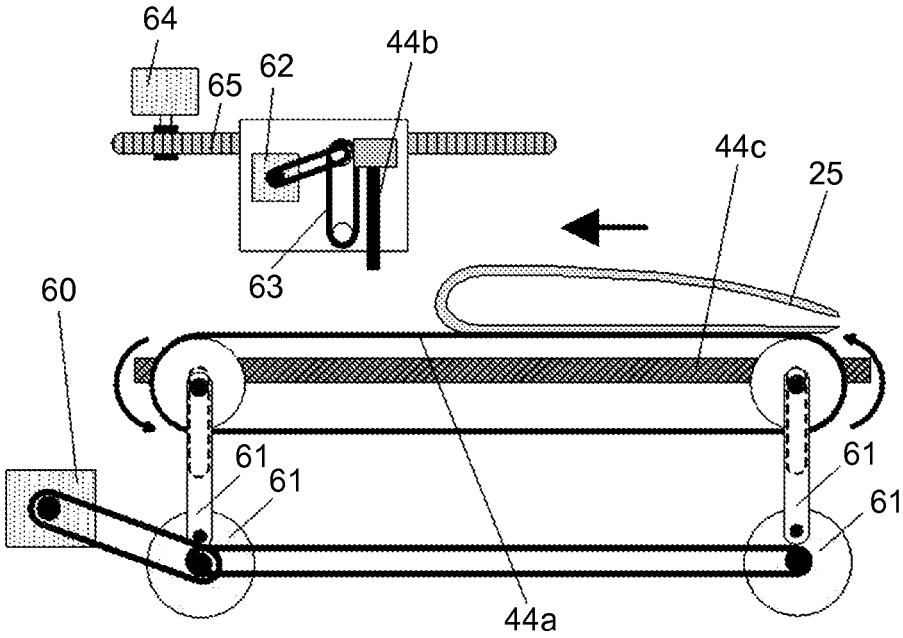
FIG. 3A is a diagram illustrating an operation method for separating a booklet from a conveying member according to a first embodiment.
Figure 3B:
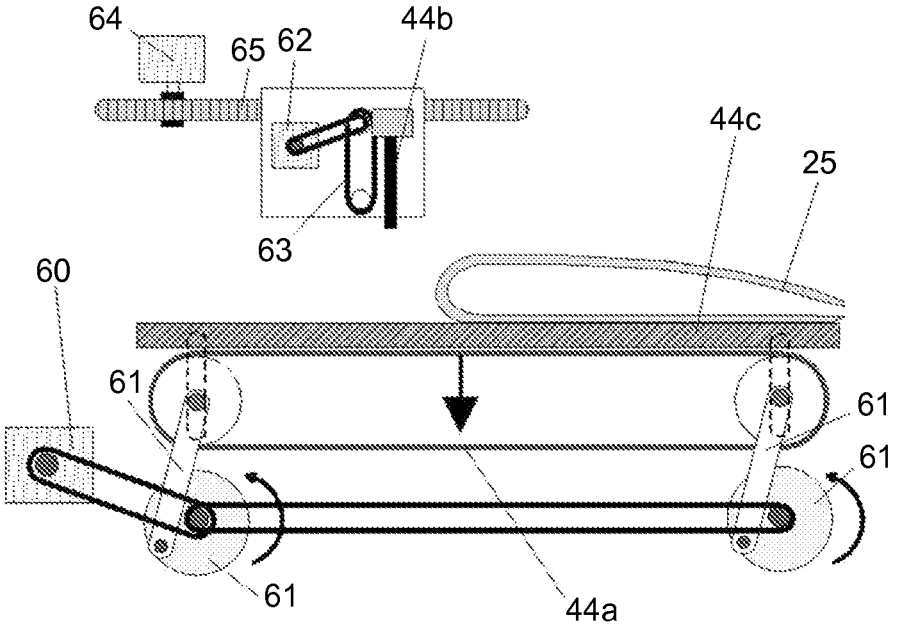
FIG. 3B is a diagram illustrating an operation method for separating the booklet from the conveying member according to the first embodiment.
Figure 3C:
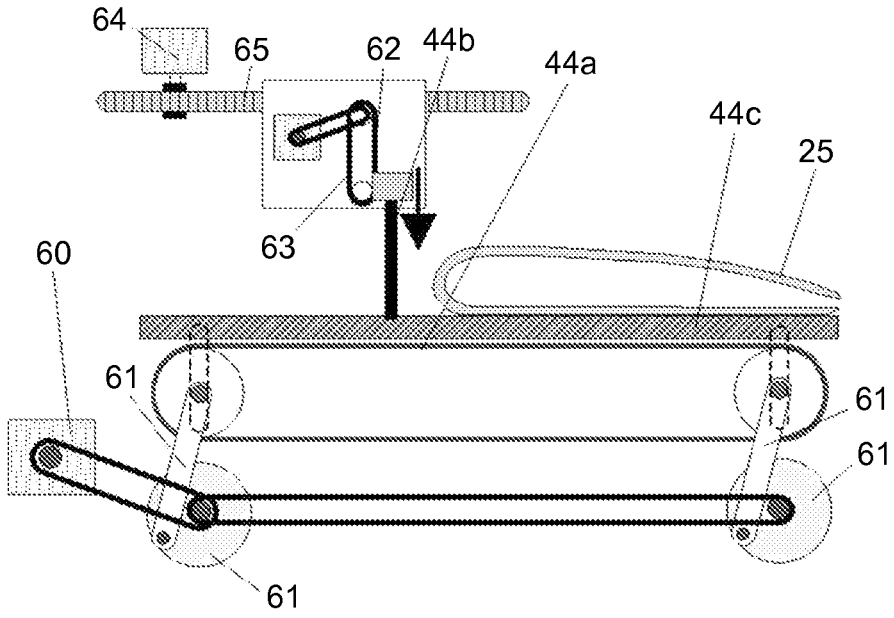
FIG. 3C is a diagram illustrating an operation method for separating the booklet from the conveying member according to the first embodiment.
Figure 3D:
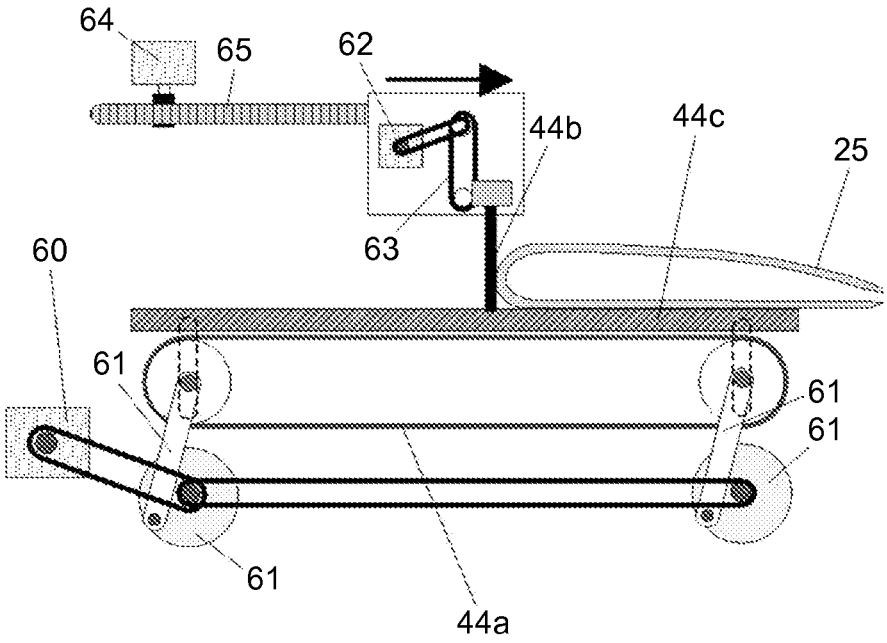
FIG. 3D is a diagram illustrating an operation method for separating the booklet from the conveying member according to the first embodiment.

As illustrated in FIG. 3A, the booklet 25 on which the center folding process has been performed by the post-processing apparatus 9 is conveyed slightly downstream from the cutting position by the conveying member 44*a*. Next, the driving of the conveying member 44*a* is stopped, and as illustrated in FIG. 3B, the conveying member 44*a* is lifted down until an upper surface of the conveying member 44*a* becomes lower than an upper surface of the supporting member 44*c* by the conveying member lifting motor 60 and the conveying member lifting mechanism 61, and thereafter, the conveying member is stopped. Therefore, the booklet 25 becomes supported by the supporting member 44*c*. Next, as illustrated in FIG. 3C, the abutting member 44*b* is lifted down to a position to be equal to or lower in height than a contact surface between the booklet 25 and the supporting member 44*c* by the abutting member lifting motor 62. Next, as illustrated in FIG. 3D, the abutting member 44*b* is moved to an upstream side in the conveying direction by the abutting member conveying direction moving motor 64 and the abutting member conveying direction moving mechanism 65 so as to abut on a center-folded surface of the booklet 25, and the booklet 25 is further moved to the cutting position by maintaining sliding posture. Therefore, the position setting can be performed without sliding on the conveying member that has a high frictional coefficient, and it becomes possible to prevent cover peeling or an opposite arrangement between a right page and a left page when the booklet is opened after cutting off an edge ob the booklet 25. Next, cutting is performed by the cutter unit 41, and after the cutting, the conveying member 44*a* is returned from the separation position to the conveying position by the conveying member lifting motor 60 and the conveying member lifting mechanism 61, and the conveyance is restarted.

Second Embodiment

FIGS. 4A to 4D are diagrams illustrating an operation method for separating a booklet from a conveying member according to a second embodiment. In FIG. 4, the position setting unit includes a conveying member 44*a*, an abutting member 44*b*, and a supporting member 44*c*. In addition, with respect to the driving of the elements, a supporting member lifting motor 66, a supporting member lifting mechanism 67, an abutting member lifting motor 62, an abutting member lifting mechanism 63, an abutting member conveying direction moving motor 64, and an abutting member conveying direction moving mechanism 65 are provided therein.

Figure 4A:
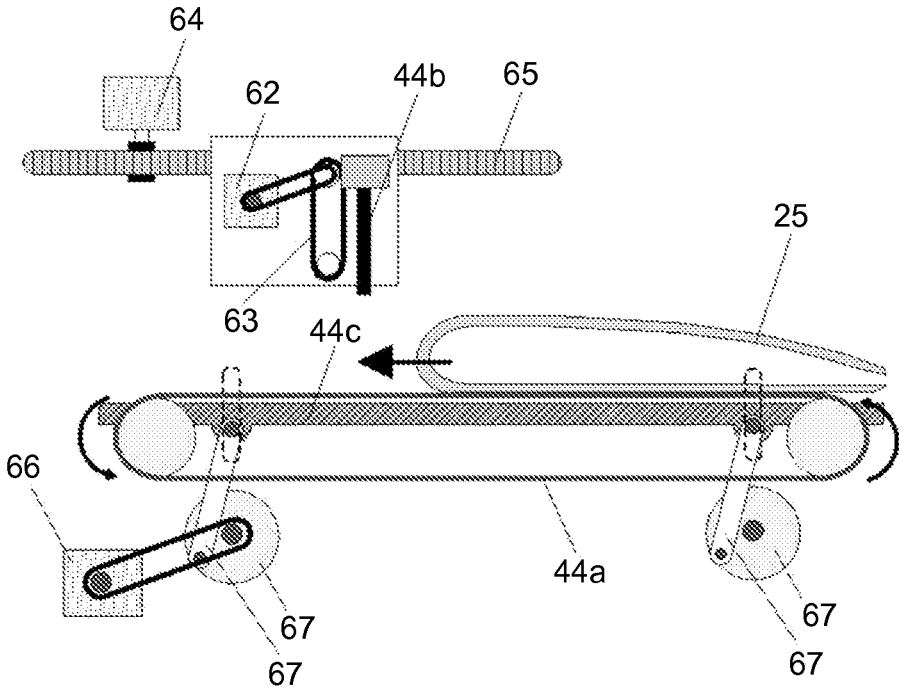
FIG. 4A is a diagram illustrating an operation method for separating a booklet from a conveying member according to a second embodiment.
Figure 4B:
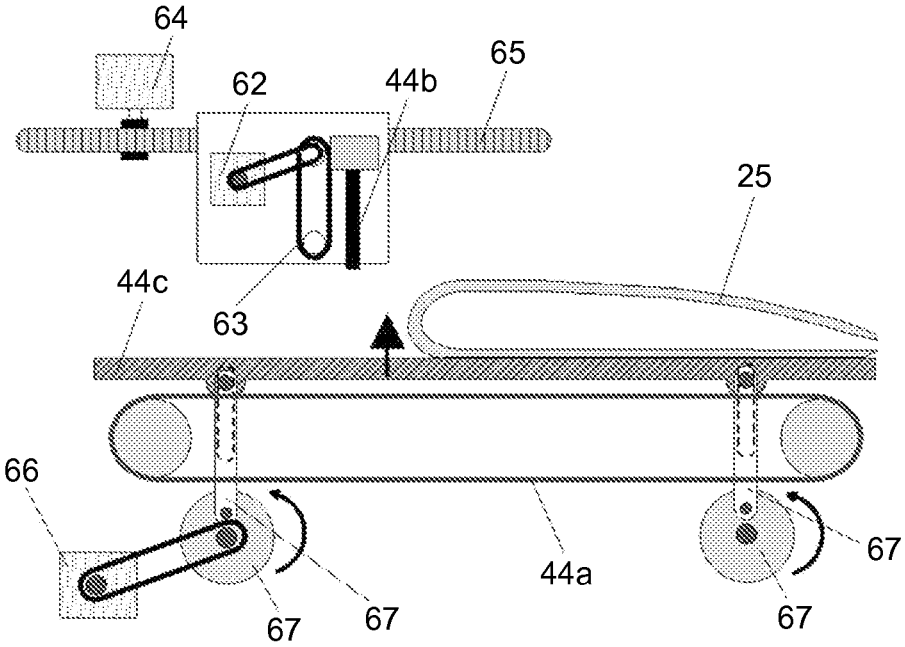
FIG. 4B is a diagram illustrating an operation method for separating the booklet from the conveying member according to the second embodiment.
Figure 4C:
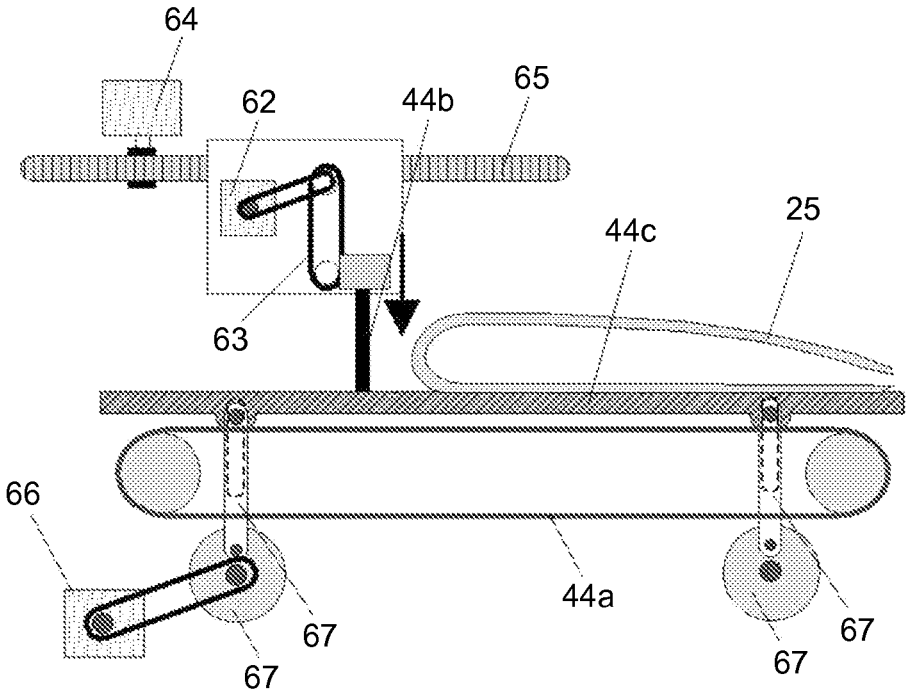
FIG. 4C is a diagram illustrating an operation method for separating the booklet from the conveying member according to the second embodiment.
Figure 4D:
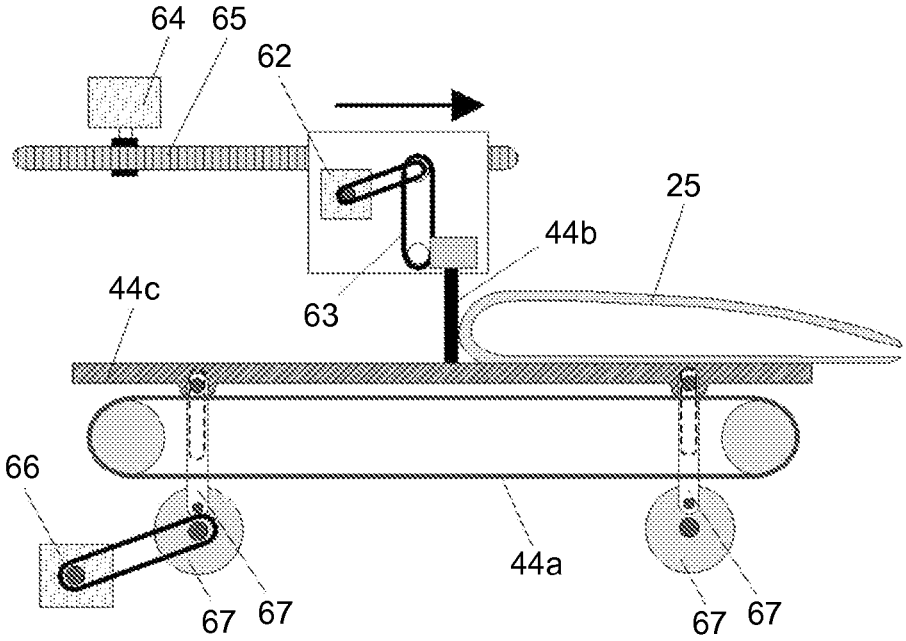
FIG. 4D is a diagram illustrating an operation method for separating the booklet from the conveying member according to the second embodiment.

As illustrated in FIG. 4A, the booklet 25 on which the center folding process has been performed by the post-processing apparatus 9 is conveyed slightly downstream from the cutting position by the conveying member 44*a*. Next, the driving of the conveying member 44*a* is stopped, and as illustrated in FIG. 4B, the supporting member 44*c* is moved up so that an upper surface of the supporting member 44*c* becomes higher than an upper surface of the conveying member 44*a* by the supporting member lifting motor 66 and the supporting member lifting mechanism 67, and thereafter, the supporting member 44*c* is stopped. Because the upper surface of the supporting member 44*c* is moved up so as to be higher than the upper surface of the conveying member 44*a*, the booklet 25 is in the state that the booklet 25 is supported by the supporting member 44*c*. Next, as illustrated in FIG. 4C, the abutting member 44*b* is lifted down to a position lower than a contact surface between the booklet 25 and the supporting member 44*c* by the abutting member lifting motor 62 and the abutting member lifting mechanism 63. Next, as illustrated in FIG. 4D, the abutting member 44*b* is moved to an upstream side in the conveying direction by the abutting member conveying direction moving motor 64 and the abutting member conveying direction moving mechanism 65 so as to abut on a center-folded surface of the booklet, and the booklet 25 is moved to a cutting position while sliding posture is maintained. Therefore, position setting can be performed without sliding on the conveying member 44*a* with high friction, so that it becomes possible to prevent cover peeling or an opposite arrangement between a right page and a left page when the booklet is opened after cutting off an edge ob the booklet 25. Next, cutting is performed by the cutter unit 41, and after the cutting, the supporting member 44*c* is returned from a booklet abutting position to a separation position by the supporting member lifting motor 66 and the supporting member lifting mechanism 67, and conveyance of the conveying member 44*a* is restarted.

Third Embodiment

Figure 5A:
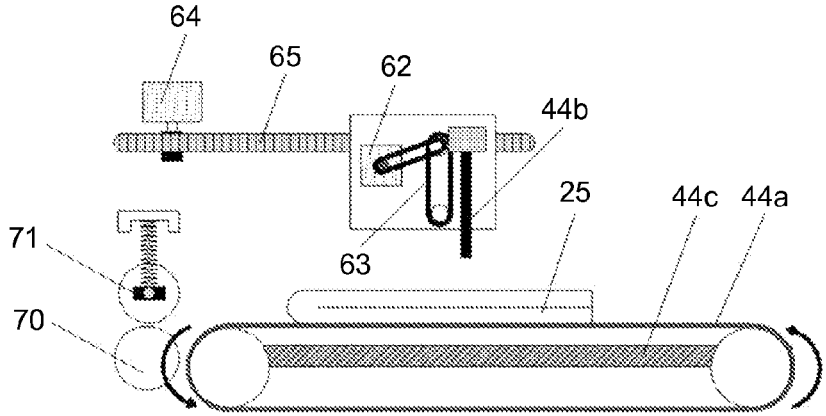
FIG. 5A is a diagram illustrating an operation method for separating a booklet from a conveying member according to a third embodiment.
Figure 5B:
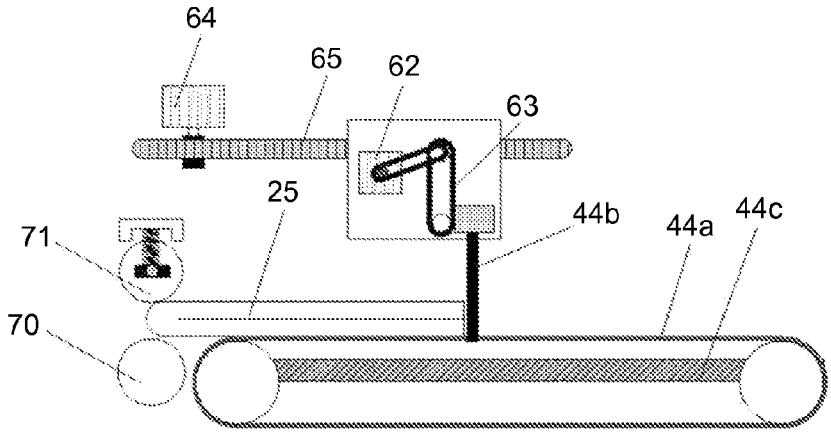
FIG. 5B is a diagram illustrating an operation method for separating the booklet from the conveying member according to the third embodiment.
Figure 5C:
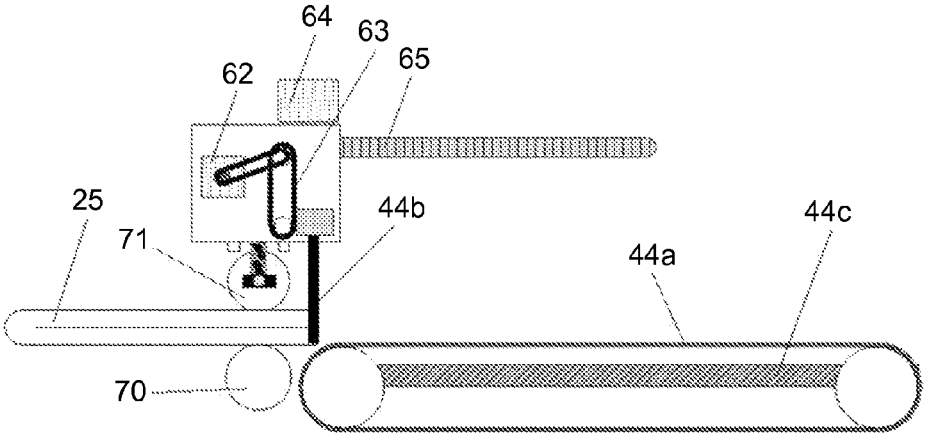
FIG. 5C is a diagram illustrating an operation method for separating the booklet from the conveying member according to the third embodiment.

FIGS. 5A to 5C are diagrams illustrating an operation method for separating a booklet from a conveying member according to a third embodiment. As illustrated in FIG. 5A, after cutting the booklet, the booklet 25 is conveyed toward a discharging portion by the conveying member. When a leading edge of the booklet reaches a discharging roller, as illustrated in FIG. 5B, an abutting member is lifted down to a conveying surface to abut a trailing edge of the booklet that is in a process of discharging. Next, as illustrated in FIG. 5C, the trailing edge of the booklet discharged by the discharging roller is pushed by the abutting member to assist the discharging operation. Therefore, incomplete discharging of the booklet with the trailing edge remaining in the apparatus can be prevented.

According to the embodiments, a frictional force associated with a position setting of a booklet in a cutting device can be reduced, and booklet conveyance is stably performed, thereby a quality of the booklet can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing apparatus that performs a cutting process on a booklet formed by a bundle of center-folded sheets of paper, the sheet post-processing apparatus comprising:

a conveying member that conveys the booklet;

a leading edge stopper capable of reciprocating in a booklet conveying direction and used for setting a cutting position where the cutting process is to be performed by abutting on a center-folded portion of the booklet; and a supporting member that supports the booklet when the cutting position of the booklet is to be set, wherein when the booklet is being conveyed, the conveying member and the conveyed booklet are located in a contact position where the conveying member and the conveyed books are in contact with each other, and when the cutting position of the booklet is to be set, each of the conveying member and the conveyed booklet is located in one of separated positions that are separated from each other, and the cutting position of the booklet is set by the leading edge stopper while the conveyed booklet is supported by the supporting member.

2. The sheet post-processing apparatus according to claim 1, further comprising:

a conveying member lifting mechanism that lifts the conveying member up and down, wherein the conveying member lifting mechanism lifts the conveying member down when the cutting position of the booklet is to be set so as to support the conveyed booklet by the supporting member.

3. The sheet post-processing apparatus according to claim 1, further comprising:

a supporting member lifting mechanism that lifts the supporting member up and down, wherein when the cutting position of the booklet is to be set, the supporting member lifting mechanism lifts the supporting member up so as to support the booklet, that is conveyed by being located on top of the conveying member, by the supporting member.

4. The sheet post-processing apparatus according to claim 1, further comprising a second moving unit capable of moving the leading edge stopper up and down.

5. The sheet post-processing apparatus according to claim 1, wherein after processing the sheet, the conveying member and the conveyed booklet are returned to the contact position from the separated positions, and the booklet is conveyed by the conveying member again.

6. The sheet post-processing apparatus according to claim 1, wherein, when the sheet is to be discharged, the leading edge stopper abuts on a trailing edge of the sheet to be discharged so as to move the sheet in the sheet conveying direction, thereby assisting the sheet to be discharged.

7. An image forming apparatus comprising a sheet post-processing apparatus that includes:

a sheet cutting device that performs a cutting process on a booklet formed by a bundle of center-folded sheets of paper and that includes:

a conveying member that conveys the booklet;

a leading edge stopper capable of reciprocating in a booklet conveying direction and used for setting a cutting position where the cutting process is to be performed by abutting on a center-folded portion of the booklet; and a supporting member that supports the booklet when the cutting position of the booklet is to be set, wherein when the booklet is being conveyed, the conveying member and the conveyed booklet are located in a contact position where the conveying member and the conveyed books are in contact with each other, and when the cutting position of the booklet is to be set, each of the conveying member and the conveyed booklet is located in one of separated positions that are separated from each other, and the cutting position of the booklet is set by the leading edge stopper while the conveyed booklet is supported by the supporting member.

8. The image forming system comprising:

the image forming apparatus according to claim 7.

9. An image forming system comprising a sheet post-processing apparatus that includes:

a sheet cutting device that performs a cutting process on a booklet formed by a bundle of center-folded sheets of paper and that includes:

a conveying member that conveys the booklet;

a leading edge stopper capable of reciprocating in a booklet conveying direction and used for setting a cutting position where the cutting process is to be performed by abutting on a center-folded portion of the booklet; and a supporting member that supports the booklet when the cutting position of the booklet is to be set, wherein when the booklet is being conveyed, the conveying member and the conveyed booklet are located in a contact position where the conveying member and the conveyed books are in contact with each other, and when the cutting position of the booklet is to be set, each of the conveying member and the conveyed booklet is located in one of separated positions that are separated from each other, and the cutting position of the booklet is set by the leading edge stopper while the conveyed booklet is supported by the supporting member.

* * * * *